US007785420B2

(12) United States Patent
Beijbom et al.

(10) Patent No.: US 7,785,420 B2
(45) Date of Patent: Aug. 31, 2010

(54) METHOD FOR CLEANING A SPRAY GUN

(75) Inventors: Peter Beijbom, Uardavägen (SE); Niklas Johansson, Amiralsgatan (SE); Christian Norman, Rörbäcksvägen (SE)

(73) Assignee: Hedson Technologies AB, Arlov (SE)

( * ) Notice: Subject to any disclaimer, the term of this patent is extended or adjusted under 35 U.S.C. 154(b) by 420 days.

(21) Appl. No.: 11/497,004

(22) Filed: Aug. 1, 2006

(65) Prior Publication Data

US 2008/0029128 A1 Feb. 7, 2008

(51) Int. Cl.
*B08B 9/00* (2006.01)

(52) U.S. Cl. ..... 134/22.1; 134/26

(58) Field of Classification Search ..... 134/22.1, 134/104.1, 104.2
See application file for complete search history.

(56) References Cited

U.S. PATENT DOCUMENTS

| | | | | | |
|---|---|---|---|---|---|
| 2,726,667 | A | | 12/1955 | Wigmore | |
| 3,276,988 | A | * | 10/1966 | Williams | 204/284 |
| 3,381,845 | A | * | 5/1968 | MacDonald | 220/301 |
| 3,771,539 | A | * | 11/1973 | De Santis | 134/111 |
| 3,904,431 | A | | 9/1975 | Dinerrman | |
| 4,025,363 | A | | 5/1977 | De Santis | |
| 4,324,242 | A | * | 4/1982 | Cross | 604/213 |
| 4,570,278 | A | * | 2/1986 | Bloome et al. | 15/97.1 |
| 4,785,836 | A | * | 11/1988 | Yamamoto | 134/56 R |
| 4,819,677 | A | | 4/1989 | Stern | |
| 4,823,820 | A | | 4/1989 | Larson et al. | |
| 4,827,955 | A | | 5/1989 | Stern | |
| 4,830,882 | A | | 5/1989 | Ichinose et al. | |
| 5,174,317 | A | | 12/1992 | Robb et al. | |
| 5,183,066 | A | * | 2/1993 | Hethcoat | 134/54 |
| 5,213,119 | A | | 5/1993 | Kusz et al. | |
| 5,318,056 | A | | 6/1994 | Kusz et al. | |
| 5,505,387 | A | | 4/1996 | Yaworski | |
| 5,513,938 | A | * | 5/1996 | Chambers | 414/427 |
| 5,704,381 | A | | 1/1998 | Millan et al. | |
| 5,855,218 | A | | 1/1999 | Giannetti | |
| 6,000,429 | A | * | 12/1999 | Van Marcke | 137/624.11 |
| 6,003,530 | A | | 12/1999 | Giuseppe | |
| 6,779,535 | B2 | | 8/2004 | Drukarov | |
| 2004/0128000 | A1 | * | 7/2004 | Phillips et al. | 700/25 |

FOREIGN PATENT DOCUMENTS

| | | |
|---|---|---|
| DE | 8816624.4 | 1/1990 |
| DE | 3875412 | 10/1992 |
| DE | 19939375 | 11/2001 |
| DE | 69618815 | 10/2002 |
| DE | 69817919 | 7/2004 |
| DE | 102004044475 | 12/2005 |
| DE | 10394135 | 1/2006 |
| DE | 602005001173 | 8/2007 |
| EP | 2 195 737 A | 4/1988 |
| EP | 0333040 | 3/1989 |
| EP | 1327485 | 7/2003 |
| EP | 1 338 347 A2 | 8/2003 |
| EP | 1 386 671 A1 | 2/2004 |

* cited by examiner

*Primary Examiner*—Michael Kornakov
*Assistant Examiner*—Ryan Coleman
(74) *Attorney, Agent, or Firm*—Tarolli, Sundheim, Covell & Tummino LLP

(57) ABSTRACT

A cleaning unit for cleaning a spray gun positioned in or within a direct vicinity to a spray booth includes a cleaning nozzle and a media delivering system. A valve communicates with the media delivering system and controls an outflow of cleaning media from the cleaning nozzle.

18 Claims, 8 Drawing Sheets

METHOD FOR CLEANING A SPRAY GUN

TECHNICAL FIELD

The present invention relates to a method and apparatus for cleaning a spray gun, and more specifically for cleaning a spray gun after use inside a paint spray booth or within a preparatory area.

BACKGROUND ART

Published British patent application GB 2195737 entitled Solvent Container for Cleaning Spray Guns describes an element used for cleaning a spray gun. The element comprises a container in which the spray gun is inserted for cleaning. The element further comprises a suction system and which system inside the container has an intake for gases and vapors. Solvent vapors from cleaning of the spray gun are, during cleaning, sucked into the intake and transported to a suitable storage system. The spray gun is cleaned by a cleaning media, e.g. a detergent, which cleaning media is applied externally on the spray gun. The spray gun further comprises an internal paint distributing passage. This passage is cleaned by a cleaning media which passes through the passage. The cleaning media is introduced inside the passage by changing content in a paint cup from paint to a cleaning media, which paint cup then is connected to the spray gun. The cleaning media is then introduced into the spray gun with same known technique as used for paint during use of the spray gun.

Described within U.S. Pat. No. 6,779,535 issued to Drukarov is a cleaning device for cleaning a paint brush. The device comprises a nozzle that is equipped with a valve. The valve is in an open position when a brush is moved towards the nozzle. A cleaning solution, e.g. a detergent, exits the nozzle under pressure when the valve is open. The heel or bristles of the brush are engaged against the nozzle whereby the valve opens. A flow of the detergent from the nozzle then cleans the brush.

Described in U.S. Pat. No. 5,505,387 issued to Yaworski is a paint spray booth. The paint spray booth is a room comprising a ceiling and walls and wherein a worker can spray an object, e.g. a car or e.g. a part of a car. The spray booth is an enclosed area. At least one wall is provided with the possibility to be partly open whereby an object can be placed inside the paint spray booth. A spray gun is used by the worker inside the spray booth to paint the placed object. The spray booth is equipped with an air providing system. The air providing system provides pressurized air to the spray gun.

SUMMARY OF THE INVENTION

An object of the present invention is to provide a process whereby a spray gun, which is used for painting in a paint spray booth, after use of one color is cleaned while a worker is holding the spray gun in his or her hand.

A further object of the present invention is to provide a process whereby a paint distributing passage inside the spray gun is cleaned after use of the spray gun.

An advantage afforded by a process according to the present invention is that the worker does not have to leave the paint spray booth in order to clean the spray gun.

A further advantage afforded by a process according to the present invention is that the spray gun is held by hand during the process of cleaning. As such, the worker does not have to leave the spray gun in a conventional cleaning unit for spray guns. Total time for cleaning the spray gun after use is therefore reduced. A further result is that necessary time needed for changing between two different colors is also reduced.

An example of an embodiment of the process according to the invention includes a second paint cup comprising a second paint located in or within a direct vicinity to the paint spray booth, wherein when painting of the paint contained in a first paint cup is performed. The first paint cup is changed to the second paint cup comprising the second paint, wherein the spray gun between the change of the first and the second paint cups is cleaned. Due to achieved results of the cleaning process it is possible to keep paint and to perform change between paints in or within a direct vicinity to the paint spray booth.

Another example of an embodiment of the process according to the invention includes a disposable paint cup. An advantage of using a disposable paint cup is that a step for cleaning the lid and paint cup is removed. When a worker is finished painting with a paint contained in a disposable paint cup, the cup is removed and taken care of in an environmentally correct way. This saves time for the worker as the worker only has to clean the spray gun and not the cup and lid.

Another example of an embodiment of the process according to the invention includes the cleaning unit being activated by the spray gun. After a worker has finished painting an object, the worker moves the spray gun towards the cleaning unit. As the spray gun is brought into contact with the cleaning unit the cleaning process starts. During this process the spray gun is held by the worker's hand. The cleaning process takes place inside the spray booth where the object to be painted is located or within a direct vicinity to the spray booth. The worker does not have to move away from the spray booth, nor disconnect the spray gun from pressurized air. The advantage of this is that the worker can rapidly clean the spray gun as the worker is holding the spray gun and after cleaning change to a new color and then continue painting using the same spray gun.

Another example of an embodiment of the process according to the invention includes activating the cleaning process by moving the spray gun towards a cleaning nozzle on the cleaning unit. The nozzle is provided with a valve which can open and close. Techniques for opening and closing the valve are known to a person skilled in the art. The advantage of having the spray gun activating the cleaning process is that it reduces the number of necessary steps for cleaning the spray gun compared to traditional spray gun cleaning processes.

Another example of an embodiment of the process according to the invention comprises the cleaning unit having a pedal, which pedal when pressed activates the cleaning process. The pedal is located in an area where a worker's feet are located. An advantage of this is that the pedal is close to the floor or ground and it does not take space and its location also prevents interference with objects located in the paint spray booth, e.g. clothing of the worker, which may catch on the pedal. The pedal is preferably connected to the lower part of the cleaning unit, close to the floor. The pedal is positioned on the cleaning unit to allow the pedal to be reached by a foot of a worker standing in front of the cleaning unit. The pedal communicates with a pump system in the cleaning unit. The pump system is activated by applying pressure to the pedal, typically by the worker's foot. The activation of the pump system provides a media to the cleaning nozzle. The pedal can activate the pump system in any desired manner.

Another example of an embodiment of the process according to the invention comprises the cleaning unit having a button, which button when pressed activates the cleaning process. The button can be located on a panel. The panel is placed on the cleaning unit or within a vicinity of the cleaning unit. The button, when pushed, activates an electronic unit, which then activates the cleaning process. The button is connected to the cleaning unit. The button communicates with an electronic unit which is incorporated into the cleaning unit. The electronic unit communicates with a pump system during the cleaning process. The pump is activated by applying pressure to the button, which transmits an electrical signal from the electrical unit for starting the pump. The activation of the pump system provides a media to the cleaning nozzle. The button can activate the pump system in any desired manner.

Another example of an embodiment of the process according to the invention comprises the cleaning unit having a sensor, which sensor when touched, exposed to a temperature, light, movement, or sound activates the cleaning process. The sensor communicates with an electronic unit, which unit upon activation of the sensor then activates the cleaning process. The sensor is connected to the cleaning unit. The sensor is preferably located within a direct vicinity to the cleaning nozzle. The sensor communicates with an electronic unit. The electronic unit communicates with a pump system during the cleaning process. Activating the sensor results in a communication by the sensor with the electronic unit, the electronic unit then activates the pump. The activation of the pump system provides a media to the cleaning nozzle. The sensor can activate the pump system in any desired manner.

Another example of an embodiment of the process according to the invention includes cleaning the spray gun to provide for a clean paint distributing passage and spray nozzle of the spray gun. The paint distributing passage and the spray nozzle are two parts of a spray gun after use to be cleaned. These two parts allow for the passage of paint during use of the spray gun and therefore are cleaned of old paint.

Another example of an embodiment of the process according to the invention includes a cleaning media fed to the cleaning nozzle, which cleaning nozzle upon activation opens and provides an outflow of the cleaning media, which cleaning media e.g. is a solvent suitable for cleaning paint used in a spray gun. Examples of such solvent include a thinner or a water based solvent. Other cleaning media or paint solvents known to a person skilled in the art for removing paint or cleaning a paint spray gun can be used as well as the above named examples. The cleaning media which exits the cleaning nozzle cleans the spray gun externally as well as internally.

Another example of an embodiment of the process according to the invention includes entering the cleaning media initially through a paint distributing passage inside the spray gun via an inlet on the spray gun, which inlet is provided for delivering paint to the spray gun during use of the spray gun. Paint used for spray guns is contained in paint cups. Each paint cup comprises a connection whereby the paint cup is connected to the inlet on the spray gun during use. For changing paint, the paint cup is removed and changed to a new paint cup comprising a desired color. Alternatively, the paint cup can be cleaned and filled with a desired color whereby the paint cup is reused. However, in order to avoid paint from two different paint cups being mixed with each other when changing paint cups the spray gun is cleaned. The cleaning process is initiated by removing a first paint cup connected to the spray gun used for painting. The spray gun which is held by the worker's hand is then moved to the cleaning nozzle. The cleaning nozzle is in an open position as contact is made between the cleaning nozzle and the inlet for paint on the spray gun. As the nozzle is in an open position cleaning media enters into the paint distributing passage. The cleaning media then flows through the paint distributing passage whereby the passage is cleaned and rinsed of old paint.

Another example of an embodiment of the process according to the invention includes the cleaning media being influenced by a pressure whereby the cleaning media flows in the paint distributing passage and exits the spray gun via a spray nozzle. The spray nozzle spreads the paint during use when paint exits the spray gun.

Another example of an embodiment of the process according to the invention includes moving cleaning media that has entered the paint distributing passage in a backward and forward direction. The inlet is part of the paint distributing passage. Part of the cleaning media which enters via the inlet of the paint distributing passage turns and flows out from the inlet. The cleaning media is therefore flowing in the paint distributing passage in two directions, thereby cleaning the inlet of the paint distributing passage. The cleaning nozzle is positioned in the inlet of the paint distribution passage. A gap is located between an outer surface of the cleaning nozzle that is positioned inside the inlet and the inner surface of the cleaning nozzle. Part of the cleaning media from the cleaning nozzle enters the gap from the bottom of the inlet in which the cleaning nozzle is positioned. The cleaning media in the gap moves in a direction opposite the direction of the cleaning media flowing in the paint distribution passage. Hence, the cleaning media inserted into the gap has a backward direction compared to the forward direction in the paint distributing passage.

Another example of an embodiment of the process according to the invention includes removing cleaning media inside the paint distributing passage after the spray gun is removed from the cleaning nozzle. The cleaning media is removed from the spray gun by using air connected to the spray gun, which air during use of the spray gun is provided to generate a spraying function of paint from the spray gun. The spray gun uses the same air pressure supply for cleaning the spray gun which also is used during use of the spray gun. An advantage of this is that the spray gun does not have to be disconnected from the air pressure supply during cleaning of the spray gun.

Another example of an embodiment of the process according to the invention includes removing cleaning media inside the paint distributing passage after the spray gun is removed from the cleaning nozzle by connecting a second air pressure supply from the cleaning unit to the spray gun. Air from the second pressure supply then blows the paint distribution passage free of cleaning media and old paint. If by any reason the spray gun has to be disconnected from its normal air supply, the cleaning process can still be performed by connecting the second air pressure supply to the spray gun.

A further object of the present invention is to provide a cleaning unit for cleaning a spray gun which spray gun uses disposable cups and which cleaning unit is positioned in or within a direct vicinity to a paint spraying booth or a preparatory area.

A further object of the present invention is to provide a cleaning unit for cleaning a spray gun that during cleaning is held by a hand and which cleaning unit is positioned in or within a direct vicinity to a paint spraying booth or a preparatory area.

A further object of the present invention is also to provide a paint spray booth enabling a worker painting inside or within a direct vicinity to the paint spray booth to clean the used spray gun after use while holding the spray gun in a hand of the worker.

A further advantage afforded by a cleaning unit according to the invention includes a paint spray booth that enables a worker to clean his or her spray gun after use by holding the spray gun by a hand and thereby reducing the time needed for cleaning the spray gun compared to conventional cleaning units where a spray gun to be cleaned after use is placed in a closed container.

Another example of an embodiment of the cleaning unit and the paint spray booth according to the invention includes a valve integrated in the cleaning nozzle, which valve is in an open position when there is an outflow of cleaning media from the cleaning nozzle, and the valve is in a closed position when there is no outflow of cleaning media. As such, only one action is performed by the worker on the cleaning unit in order to start an outflow of cleaning media from the cleaning nozzle. This action is to provide contact between spray gun and cleaning nozzle.

Another example of an embodiment of the cleaning unit and the paint spray booth according to the invention includes the valve in an open position when an inlet for paint on the spray gun is pressed onto the cleaning nozzle, and the valve is in a closed position when no pressure is applied to the cleaning nozzle. An advantage of this is that the unit requires no manual turning off or on in order to control a flow of cleaning media through the cleaning nozzle.

Another example of an embodiment of the cleaning unit and the paint spray booth includes the cleaning nozzle being situated in a direction such that its outflow is directed in a direction of gravity. To open the valve, the spray gun and its inlet are pressed in an upward direction against the cleaning nozzle. The spray gun is prepared for cleaning whereby the paint cup comprising the used paint is disconnected from the paint inlet on the spray gun. The direction of the cleaning nozzle and the spray gun with a paint inlet on its upper part allows the inlet to be moved into cleaning position without the need of turning or twisting the spray gun in to a correct position.

Another example of an embodiment of the cleaning unit and the paint spray booth includes the cleaning nozzle being oriented in such a direction that its outflow is directed in a opposite direction of gravity, whereby to open the valve the inlet of the spray gun is pressed in a downward direction against the cleaning nozzle. An advantage of this is that the spray gun can rest against the cleaning nozzle during cleaning and no force is needed to keep the spray gun in an elevated position.

Another example of an embodiment of the cleaning unit and the paint spray booth includes the cleaning media being fed to the cleaning nozzle via a pump, which pump is controlled by a valve which is integrated in the cleaning nozzle. The pump allows the cleaning media to reach the cleaning nozzle. The cleaning media leaves the cleaning nozzle under pressure generated from the pump. The cleaning media then enters the paint distributing passage and flows through the passage with a force that improves the cleaning and rinsing effect inside the passage.

Another example of an embodiment of the cleaning unit and the paint spray booth includes the cleaning media being fed to the cleaning nozzle due to an influence of a force of gravity. A valve is integrated in the cleaning nozzle, and controls the outflow from the cleaning nozzle of the cleaning media, which outflow is influenced by the force of gravity. Due to gravity, it is possible to position a container having a cleaning media on a level above the cleaning unit and thereby receive an outflow of cleaning media from the cleaning nozzle.

Another example of an embodiment of the cleaning unit and the paint spray booth includes the cleaning media being fed to the cleaning nozzle via a venturi nozzle. The venturi nozzle is controlled by a valve that is integrated into the cleaning nozzle. The venturi nozzle communicates with the cleaning media, a pressurized air unit providing pressurized air, and the cleaning nozzle. The pressurized air enters the venturi nozzle causing cleaning media to be pulled into the venturi nozzle from a container comprising the cleaning media. The pressurized air and the cleaning media exit the cleaning nozzle together.

Another example of an embodiment of the cleaning unit and the paint spray booth includes a T-member comprising an air intake connected to the media delivering system that communicates with the venturi nozzle. The T-member is connected to the media delivering system. In accordance with one alternative embodiment, the T-member is integrated into the venturi nozzle. Hence, the T-member is located between the cleaning nozzle and the container comprising the cleaning media. By closing the air intake of the T-member the cleaning media is fed to the cleaning nozzle via the venturi nozzle. Opposite flow of the cleaning media is interrupted to the cleaning nozzle if the air intake is open and hence provides air flowing through the T-member. As a result, the cleaning nozzle switches between cleaning media and pressurized air that exits from the cleaning nozzle.

Another example of an embodiment of the cleaning unit and the paint spray booth includes the cleaning media being fed into the cleaning nozzle due to pressure of tap water. A valve integrated in the cleaning nozzle controls the outflow from the cleaning nozzle of the cleaning media, which outflow is influenced by the tap water. An advantage of this is that the tap water is the cleaning media. Therefore it is not necessary to use an extra container for the cleaning media. This is because the tap water can be connected directly to the cleaning unit from a tap water unit. Tap water in general comprises a pressure in order to generate a flow of water from a water tap. By using tap water as a cleaning media that is transported to the cleaning nozzle a pump for providing the cleaning media to the cleaning nozzle is not needed. The flow of cleaning media is thus controlled by the valve in the cleaning nozzle.

Another example of an embodiment of the cleaning unit and the paint spray booth includes the cleaning media being contained in a container under a high pressure, which pressure inside the container is higher than pressure of atmosphere applied outside the container. The cleaning media, due to the high pressure inside the container, is transported to the cleaning nozzle, whereby an outflow of cleaning media through the cleaning nozzle is generated.

Another example of an embodiment of the cleaning unit and the paint spray booth comprises the cleaning unit having a plurality of cleaning nozzles. An advantage of having a second cleaning nozzle is that it would be possible to clean the outer surface on the spray nozzle and other parts of the spray gun with this second cleaning nozzle. This is because old paint mixed with the cleaning media that exits the spray nozzle after passing through the paint distributing passage can accidentally stick to the outer surface of the spray nozzle.

Another example of an embodiment of the cleaning unit and the paint spray booth comprises the cleaning unit including a means having a shielding function, which means forms a chamber, e.g. a flushing bowl, which chamber comprises an opening for inserting a spray gun from outside the chamber to inside the chamber. The chamber further comprises the cleaning nozzle, which is surrounded by the chamber, where inside the chamber the cleaning of the spray gun is performed. The main part of the cleaning media is maintained inside the chamber, which cleaning media in the chamber is led out via a drainage in the chamber, which drainage is located under the cleaning nozzle. The center of the drainage and the center of the cleaning nozzle are the two objects inside the chamber farthest away from each other. The distance between the drainage and the cleaning nozzle determine the height of the chamber in which the spray gun is placed during cleaning. The height is adjusted to the size of a normal spray gun held in a normal working position by a person skilled in the art. This means that when the spray gun is held in the normal working position, the height is greater than the width of the chamber in order to optimize the positioning of the spray gun inside the chamber. Therefore, the distance between the drainage and the center of the cleaning nozzle inside the chamber is maximized. The chamber can be located on a stand or incorporated into a wall of the paint spraying booth. Conventional cleaning units for spray guns comprise a lid for closing the chamber and leaving the spray gun inside, whereby a cleaning process starts and cleans the spray gun. The lid prevents vapors from used cleaning media in conventional cleaning units to enter outside the cleaning unit. An advantage of the cleaning unit according to the invention is that it uses an existing fan and ventilation system inside the paint spraying booth. As such, the vapors which arise from the cleaning media in the chamber are taken care of by the existing fan and ventilation system in the paint spray booth.

Another example of an embodiment of the cleaning unit and the paint spray booth includes the chamber being made of a plastic material, which plastic material is connected to the earth or is conductive whereby static electricity of the chamber is avoided.

The cleaning unit is used in an environment that requires the handling of cleaning media, paint, or other liquids which are flammable. The cleaning unit does not generate flashes or the like due to e.g. static electricity as this can cause the cleaning media, paint, or liquids to catch fire.

Another example of an embodiment of the cleaning unit and the paint spray booth comprises the cleaning unit having a wiping off element, which wiping off element is located inside the chamber and between the cleaning nozzle and the drainage. The wiping off element and cleaning nozzle have such a distance between them that allows for the positioning of the spray gun between the cleaning nozzle and wiping off element. The spray gun after cleaning is wiped off with its spray nozzle against the wiping off element in order to remove old paint.

Another example of an embodiment of the cleaning unit and the paint spray booth includes the wiping off element being mountable and dismountable to and from the chamber. The advantage of this is that the wiping off element then can be removed from the chamber for e.g. cleaning and repairing.

Another example of an embodiment of the cleaning unit and the paint spray booth includes the wiping off element being a brush. An advantage of using a brush as the wiping off element is that its wiping off surface comprises straws. The surfaces of the straws form a number of surfaces to which evaporated cleaning media sticks.

Another example of an embodiment of the cleaning unit and the paint spray booth comprises the cleaning unit having a funnel-shaped nozzle, which funnel-shaped nozzle has an open end and a drainage. The open end is a receiver of cleaning media as well as paint. The cleaning media and paint leave the spray nozzle of the spray gun after passing through the paint distributing passage of the spray gun. The drainage of the funnel-shaped nozzle is connected with the drainage of the chamber. After cleaning media has passed through the paint distributing passage of the spray gun and the spray gun has been moved away from the nozzle, the cleaning media left in the paint distributing passage is blown out into the funnel-shaped nozzle. The advantage of blowing out the cleaning media into the funnel-shaped nozzle is that the cleaning media which is typically small drops and evaporated is that the funnel-shaped nozzle encloses the blown out cleaning media from the spray gun.

Another example of an embodiment of the cleaning unit and the paint spray booth includes the funnel-shaped nozzle being located on an outer surface of the chamber and the cleaning nozzle being located on an inner surface of the chamber. In order to save space and materials used for constructing the chamber it is more efficient to have the funnel-shaped nozzle located on the outer surface of the chamber.

Another example of an embodiment of the cleaning unit and the paint spray booth includes a vacuum tank located in or within a vicinity to the cleaning unit. The vacuum tank comprises a receiving funnel, whereby the spray nozzle of the spray gun is placed into the receiving funnel, whereby a low pressure contained in the vacuum tank generates a sucking effect into the vacuum tank, whereby cleaning media and old paint contained in the paint distributing passage is sucked out from the paint distributing passage via the spray nozzle and into the vacuum tank. The cleaning media and old paint in the vacuum tank is then handled and taken care of with techniques known to a person skilled in the art.

Another example of an embodiment of the cleaning unit and the paint spray booth comprises the cleaning unit having an air nozzle. The air nozzle upon activation is used for spraying air onto the spray gun in order to blow cleaning media and/or old paint from the spray gun after the spray gun has been cleaned. As such, the worker does not have to dry or wipe of the spray gun using a towel or the like.

Another example of an embodiment of the cleaning unit and the paint spray booth includes the air nozzle having a fixed position on the cleaning unit. A fixed position is an advantage when transporting the unit. As few loose and not fixed parts as possible during handling of the cleaning unit simplifies the whole process from constructing to installing the cleaning unit.

Another example of an embodiment of the cleaning unit and the paint spray booth includes the air nozzle being fixed to the cleaning unit via a flexible member, e.g. a flexible tube, which air nozzle is operated by a hand. The air nozzle connected to the flexible member is held by the worker's one hand. The spray gun is held by the worker's other hand. As the air nozzle is connected to the flexible member the worker then blows air onto the spray gun whereby cleaning media and old paint is removed and blown away from the spray gun.

Another example of an embodiment of the cleaning unit and the paint spray booth includes the cleaning unit being mountable and dismountable. As such, parts of the cleaning unit can be changed or removed for e.g. repair or cleaning of different parts of the cleaning unit.

Another example of an embodiment of the cleaning unit and the paint spray booth comprises the cleaning unit providing a means for ventilation. The means for ventilation can be mounted on the inside as well as on the outside of the chamber. During or after cleaning of a spray gun inside the chamber the means for ventilation is activated in accordance with techniques known to a skilled person in the art. Vapors, remains of cleaning media, paint, drops, particles etc. are sucked out from the chamber via the means for ventilation and thus prevented from reaching the worker.

Another example of an embodiment of the cleaning unit and the paint spray booth includes a container suitable for cleaning media used for cleaning the spray gun being integrated into the cleaning unit. As the container for cleaning media is integrated into the cleaning unit there is no extra need for a connection from the cleaning unit to an externally located container comprising the cleaning media.

Another example of an embodiment of the cleaning unit and the paint spray booth includes a collecting tank for receiving the cleaning media used for cleaning the spray gun being integrated with the cleaning unit. Since the collecting tank for receiving used cleaning media is integrated into the cleaning unit, there is no extra need for an external connection to a drainage system away from the cleaning unit in order to take care of the used cleaning media. The used cleaning media is collected in the collecting tank and when the tank is full it is removed and transported to a location for handling such media, whereby environmental requirements are not being violated.

Another example of an embodiment of the cleaning unit and the paint spray booth comprises the cleaning unit having a washing means for receiving a paint cup and/or a lid and/or accessories to and for the spray gun, whereby the paint cup, lid and accessories to and for the spray gun are cleaned within the washing means. As such, it is possible to clean the paint cup, lid and/or accessories to and for a spray gun as these are parts that normally also need to be cleaned. Particularly this is the case when using a spray gun equipped with a reusable paint cup and lid.

Another example of an embodiment of the cleaning unit and the paint spray booth comprises the cleaning unit having a pedal. The pedal when pressed directly or indirectly generates a flow of cleaning media from the cleaning nozzle. The pedal is connected to a pump. When the pedal is pressed it activates the pump whereby cleaning media is provided to the cleaning nozzle. The pedal is preferably connected to the lower part of the cleaning unit, close to the floor. The pedal is positioned on the cleaning unit to allow the pedal to be reached by a foot of a worker standing in front of the cleaning unit. The pedal communicates with a pump system in the cleaning unit. The pump system is activated by applying pressure to the pedal, typically by the worker's foot. The activation of the pump system provides a media to the cleaning nozzle. The pedal can activate the pump system in any desired manner.

Another example of an embodiment of the cleaning unit and the paint spray booth comprises the cleaning unit having a button, which button when pressed directly or indirectly generates a flow of cleaning media from the cleaning nozzle. The button is part of an electronic device. The electronic device communicates with the pump. As the button is pressed the button indirectly activates the pump whereby a flow of cleaning media is provided to the cleaning nozzle. The button is connected to the cleaning unit. The button communicates with an electronic unit which is incorporated into the cleaning unit. The electronic unit communicates with a pump system during the cleaning process. The pump is activated by applying pressure to the button, which transmits an electrical signal from the electrical unit for starting the pump. The activation of the pump system provides a media to the cleaning nozzle. The button can activate the pump system in any desired manner.

Another example of an embodiment of the cleaning unit and the paint spray booth comprises the cleaning unit having a sensor. The sensor when touched, exposed to a temperature, light, movement, or sound directly or indirectly generates a flow of cleaning media from the cleaning nozzle. An advantage of a sensor is that it does not need a lot of space for mounting on the cleaning unit. As such, it is possible to mount a sensor on locations on the cleaning unit whereby its location does not disturb the process of cleaning in the cleaning unit. The sensor is connected to the cleaning unit. The sensor is preferably located within a direct vicinity to the cleaning nozzle. The sensor communicates with an electronic unit. The electronic unit communicates with a pump system during the cleaning process. Activating the sensor results in a communication by the sensor with the electronic unit, the electronic unit then activates the pump. The activation of the pump system provides a media to the cleaning nozzle. The sensor can activate the pump system in any desired manner.

A further object of the present invention is to provide a use of a paint spray booth comprising a cleaning unit used for painting, e.g. parts of automobiles, and where a worker inside or within a direct vicinity to the paint spray booth or a preparatory area can clean a spray gun used for painting.

An advantage afforded by a use of a paint spay booth comprising a cleaning unit according to the invention is that the worker can clean a spray gun inside or within a direct vicinity to the paint spray booth or the preparatory area. This reduces time needed for cleaning the spray gun after use, since the worker does not have to change location.

A further advantage afforded by a use of a paint spay booth comprising a cleaning unit according to the invention is that only one spray gun is needed for performing a job where a number of different colors are used. This is because the spray gun is cleaned between the change of paints or colors. This reduces the number of spray guns needed.

A further object of the present invention is to provide a use of a cleaning unit for cleaning a spray gun inside or within a direct vicinity to a paint spray booth, in which the paint spray booth is used by a worker to paint an object, such as a part of an automobile.

A further object of the present invention is to provide a method for cleaning a paint distributing passage in a spray gun after use where the spray gun is held by hand during cleaning.

An example of an embodiment of the use of a paint spay booth includes the use of a cleaning unit, and a method for cleaning comprises a cleaning nozzle having a valve, which valve is integrated into the cleaning nozzle.

DETAILED DESCRIPTION OF THE PREFERRED EMBODIMENTS

Figure 1:
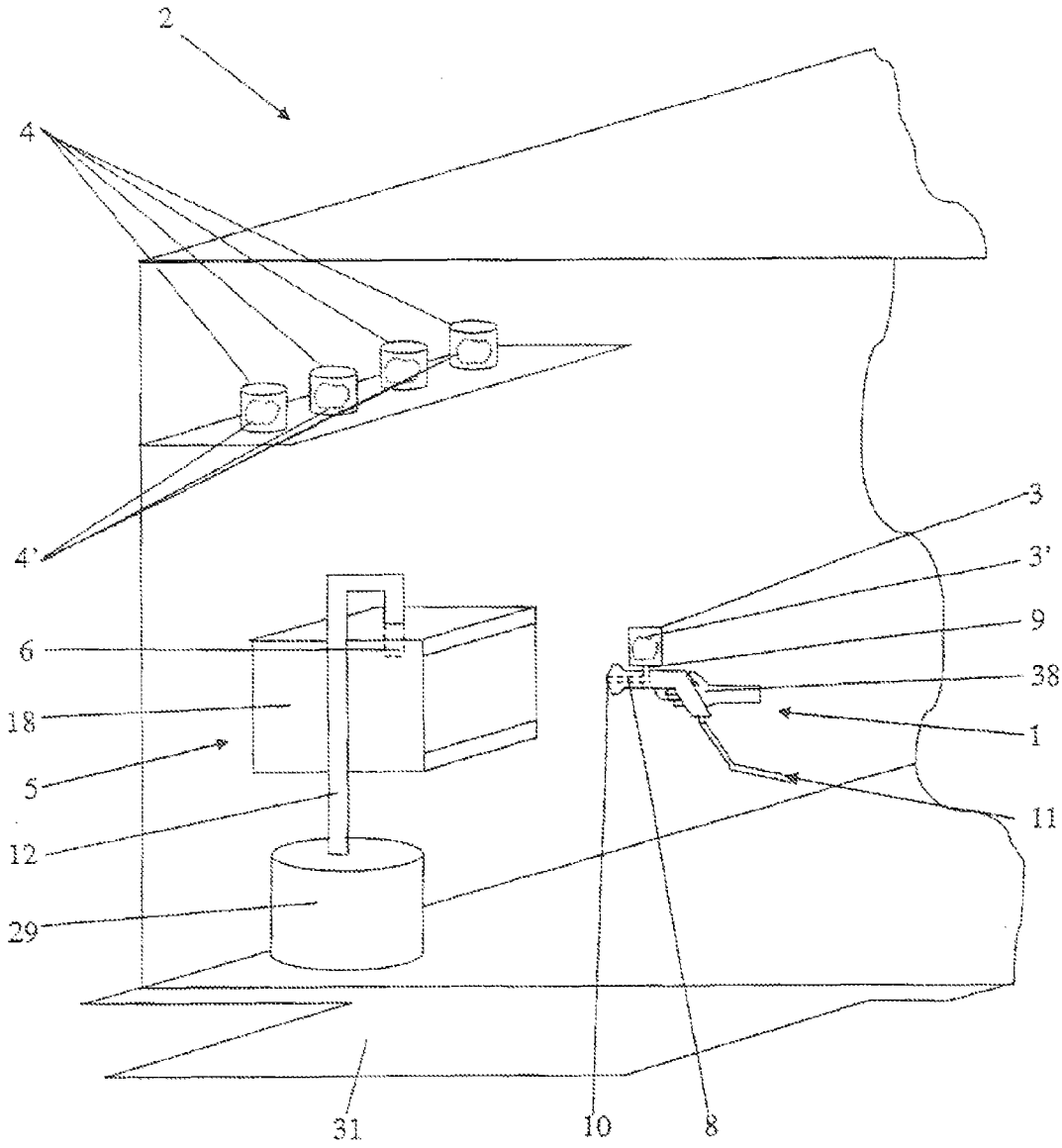
FIG. 1 depicts part of a paint spray booth comprising a cleaning unit, a spray gun, paint cups, and a preparatory area.

FIG. 1 depicts a spray gun (1) inside part of a paint spray booth (2). Inside the paint spray booth (2) is a first paint cup (3), which first paint cup (3) is connected to the spray gun (1) held by a hand (38). Inside the first paint cup (3) is a first paint contained and used for spraying. Further is a second paint cup (4) comprising a second paint placed inside the paint spray booth (2). However, the second paint cup (4) can also be placed within a direct vicinity to the paint spray booth (2) (not shown in figure). The paint is contained directly inside the paint cups. Alternatively as shown in FIG. 1 the paint is contained in small bags (3'; 4') which are placed inside the paint cups (3; 4). The paint cups with paint which are not connected to the spray gun (1) are placed in or within a direct vicinity to the paint spray booth (2), e.g. on a shelf inside the paint spray booth (2). It is also possible that the paint cups not connected to the spray gun are placed within a preparatory area (31) or inside a paint mixing room (not shown in figure). Further inside the paint spray booth (2) is a cleaning unit.

Outside the paint spray booth (2) is a preparatory area (31). This is an area where objects to be painted inside the paint spray booth (2) are prepared for a paint job. The paint job is then to be carried out in the paint spray booth (2) or within a direct vicinity to the paint spray booth (2). The preparatory area is located in a direct vicinity to the paint spray booth (2).

The cleaning unit (5) comprises a chamber (18), a media delivering system (12), a cleaning nozzle (6), and a container (29) in which a cleaning media is contained. The cleaning nozzle (6) communicates with the container (29) via the media delivering system (12).

The spray gun (1) in FIG. 1 is a conventional spray gun (1) used for spray painting inside a paint spray booth (2). The spray gun (1) is connected with an air system providing pressurized air (11) to the spray gun (1).

Figure 2:
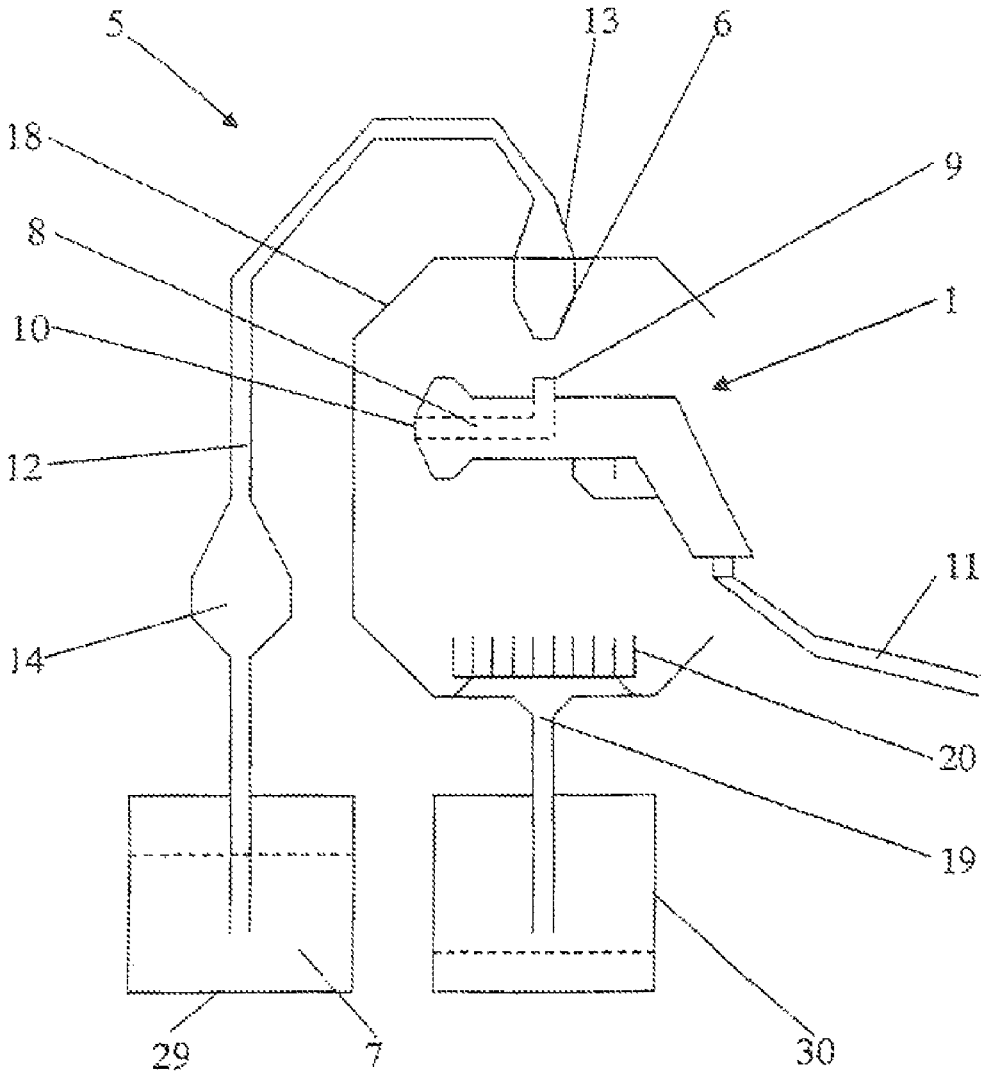
FIG. 2 depicts a cleaning unit for a spray gun before initiation of a cleaning process.

FIG. 2 depicts a cleaning unit (5). The cleaning unit (5) comprises a chamber (18), a cleaning nozzle (6), a valve (13), a wiping off element, (20) and drainage (19). The cleaning unit (5) further comprises a media delivering system (12) and a container (29) comprising a cleaning media (7). The cleaning nozzle (6) and the container (29) communicate with each other via the media delivering system (12).

According to an example of an embodiment of the invention in accordance with FIG. 2, a pump (14) is connected to the media delivering system (12). The pump (14) is controlled by the valve (13) inside the cleaning nozzle (6). The valve (13) monitors the start of the pump (14). On a lower part of the inside of the chamber (18) is a wiping off element (20). The wiping off element (20) is mountable and dismountable from the cleaning unit (5) for repairing or cleaning of the wiping off element (20).

On a lower part located under the wiping off element (20) inside the chamber (18) is a drainage (19) from the chamber (18). The drainage communicates with a collecting tank (30) positioned under the chamber (18). FIG. 2 further depicts a spray gun (1) prepared for cleaning placed inside the chamber (18). The spray gun (1) comprises a spray nozzle (10), a paint distributing passage (8), an inlet (9), which inlet (9) is a receiver for paint which is contained in a paint cup (see FIG. 1) and which paint cup (see FIG. 1) is connected to the inlet (9) of the spray gun (1). As mentioned above, the spray gun (1) in FIG. 2 is prepared for cleaning. The paint cup (see FIG. 1) has been removed before moving the spray gun (1) into a cleaning position inside the chamber (18).

Figure 3:
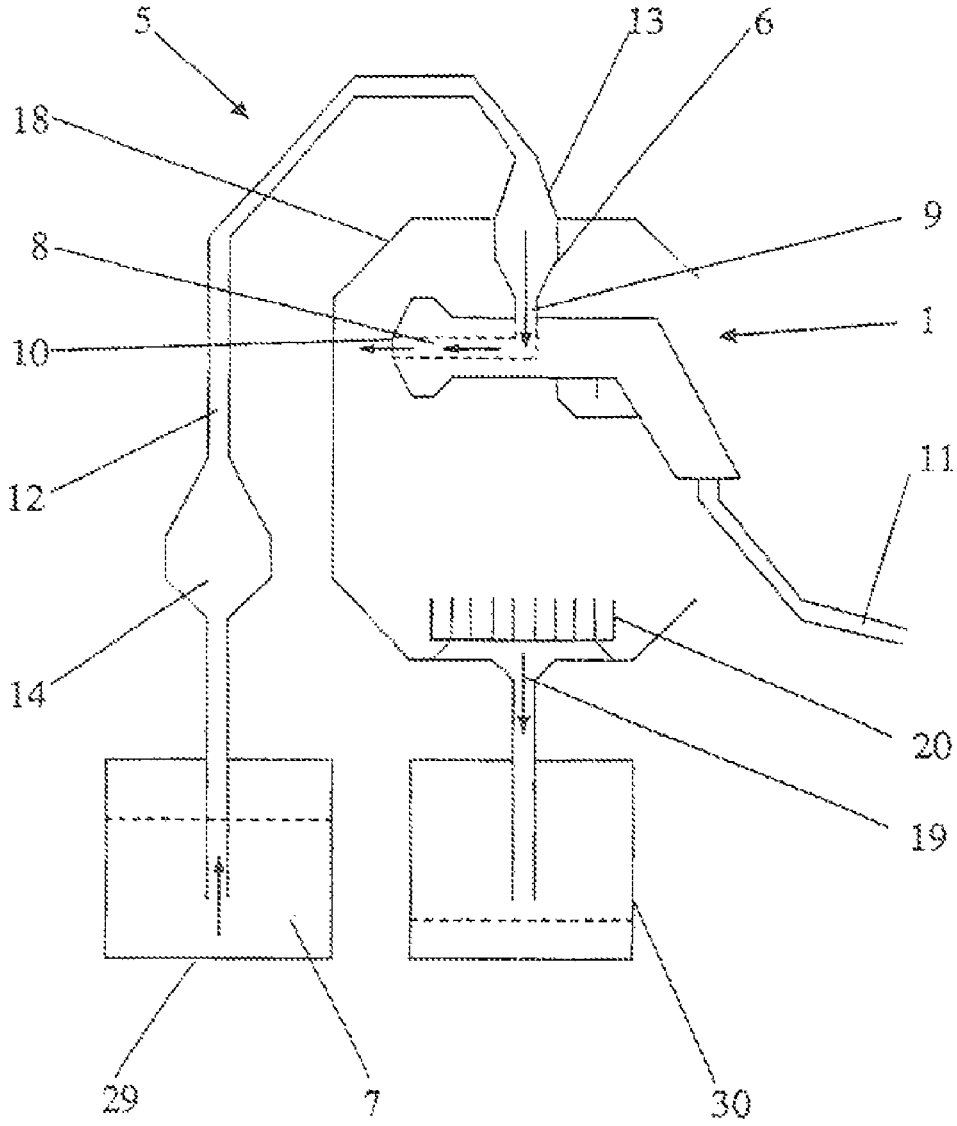
FIG. 3 depicts a cleaning unit for a spray gun when the cleaning process is initiated.

FIG. 3 depicts the spray gun (1) when the cleaning process has initiated. The spray gun (3) is oriented in such a position so that the inlet (9) is brought into contact with the cleaning nozzle (6). Contact between the cleaning nozzle (6) and the spray gun (1) opens the valve (13) inside the cleaning nozzle (6). The valve (13) is incorporated with the cleaning nozzle (6). The valve (13) can be opened in any desired manner. The valve (13) in an open position activates the pump (14). The valve (13) can activate the pump in any desired manner. The pump (14) draws a cleaning media (7) contained in a container (29) suitable for cleaning media into the media delivering system (12). The media delivering system (12) then guides the cleaning media (7) to the cleaning nozzle (6). From the cleaning nozzle (6) the cleaning media is guided into the paint distributing passage (8) inside the spray gun (1). The cleaning media (7) flows in the paint distribution passage (8) inside the spray gun (1) and exits at a spray nozzle (10) located on the spray gun (1). Cleaning media (7) which exits the spray nozzle (10) during the cleaning process is guided down to the bottom of the chamber (18) due to gravity. In the bottom of the chamber (18) is a drainage (19). The drainage (19) then guides received cleaning media (7) and paint to a collecting tank (30) suitable for used cleaning media and paint.

Figure 4:
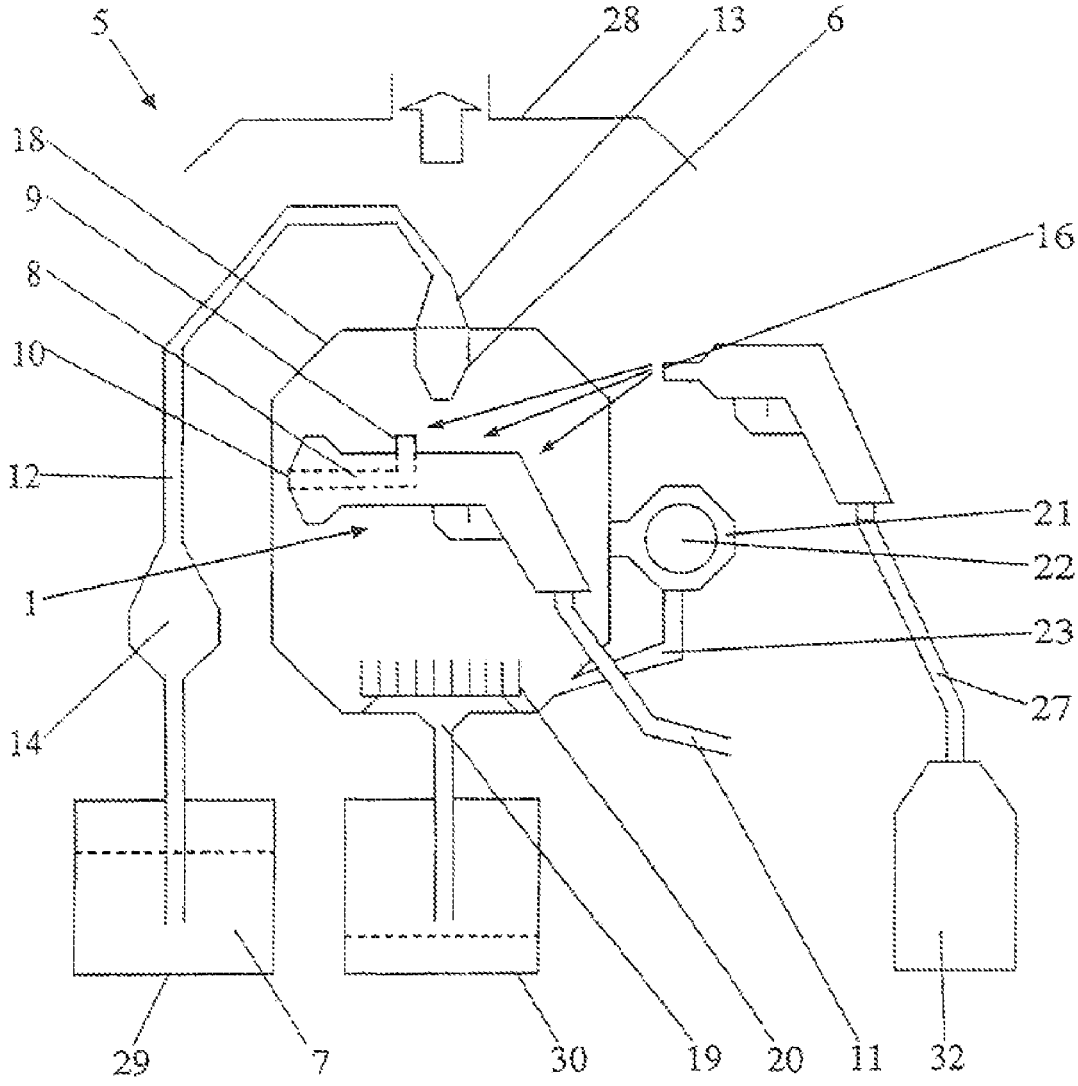
FIG. 4 depicts a cleaning unit for a spray gun after the cleaning process is performed.

FIG. 4 depicts the spray gun (1) after cleaning media (7) has entered and passed through the paint distributing passage (8). After the spray gun (1) is removed from cleaning nozzle (6) the spray nozzle (10) of the spray gun (1) is aimed into an open end (22) of a funnel-shaped nozzle (21). The spray gun (1) blows out remaining cleaning media and old paint from the paint distributing passage (8) into the funnel-shaped nozzle (21). As remaining cleaning media is blown out into the funnel-shaped nozzle (21) it is then guided via drainage (23) from the funnel-shaped nozzle (21) to the lower part of the chamber (18). When the paint distributing passage (8) is blown out, the spray nozzle is wiped off on the wiping off element (20) inside the chamber (18) (not shown in figures). This wiping off performance can also be performed before blowing out the cleaning media and old paint from the paint distributing passage (8). During the above described cleaning process cleaning media is splashed onto the exterior of the spray gun (1). Cleaning media and old paint which is on the exterior of the spray gun (1) is removed by pressurized air (32) which is led to an air nozzle (16) via a flexible member (27). In accordance with an example of an embodiment of the invention, the air nozzle (16) and the flexible member (27) are comprised in the cleaning unit.

In accordance with an example of an embodiment of the invention, the cleaning unit (5) includes a means for ventilation (28), see FIG. 4. Vapors and gases generated during cleaning and as well as during painting are guided into the means for ventilation (28). The means for ventilation (28) communicates with a unit known to a skilled person for handling the mentioned generated vapors and gases.

Figure 5:
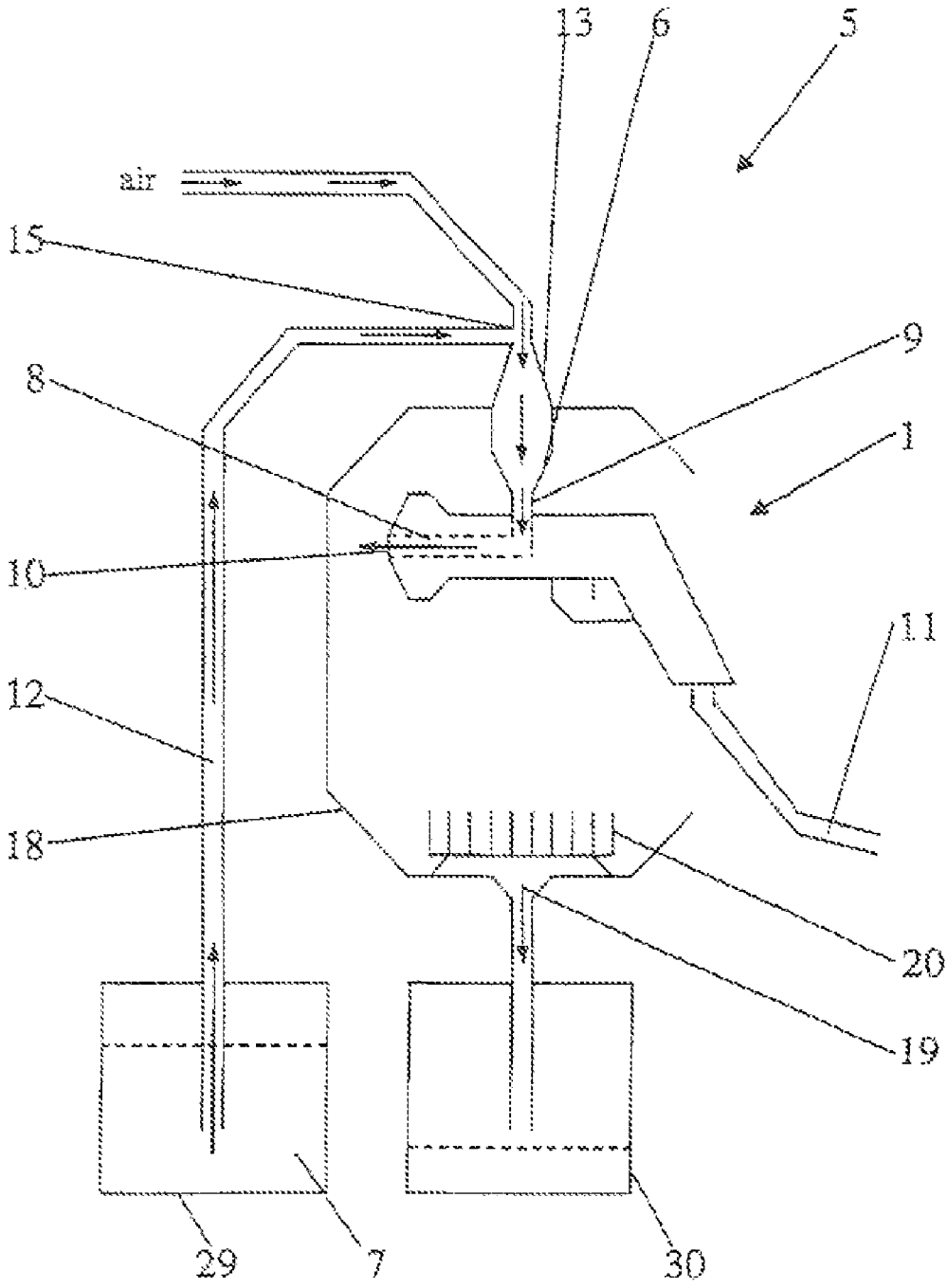
FIG. 5 depicts a cleaning unit having a venturi nozzle.

FIG. 5 depicts the spray gun (1) when the cleaning process has initiated. In accordance with an example of an embodiment of the invention, the cleaning unit (5) includes a media delivering system (12) which communicates with the cleaning nozzle (6). Instead of a pump as described in FIG. 3, the cleaning media (7) is fed to the cleaning nozzle (6) via a venturi nozzle (15). The venturi nozzle (15) is controlled by the valve (13). The valve (13) is integrated in the cleaning nozzle (6). When the valve (13) is in an open position due to activation, air flows through the venturi nozzle (15) whereby cleaning media is drawn to the venturi nozzle (15). The cleaning media (7) and the air which has entered the venturi nozzle (15) are guided out through the cleaning nozzle (6). From the cleaning nozzle (6) the cleaning media (7) is mixed with air then guided into and through the paint distributing passage (8) as described above for FIG. 3.

Figure 6:
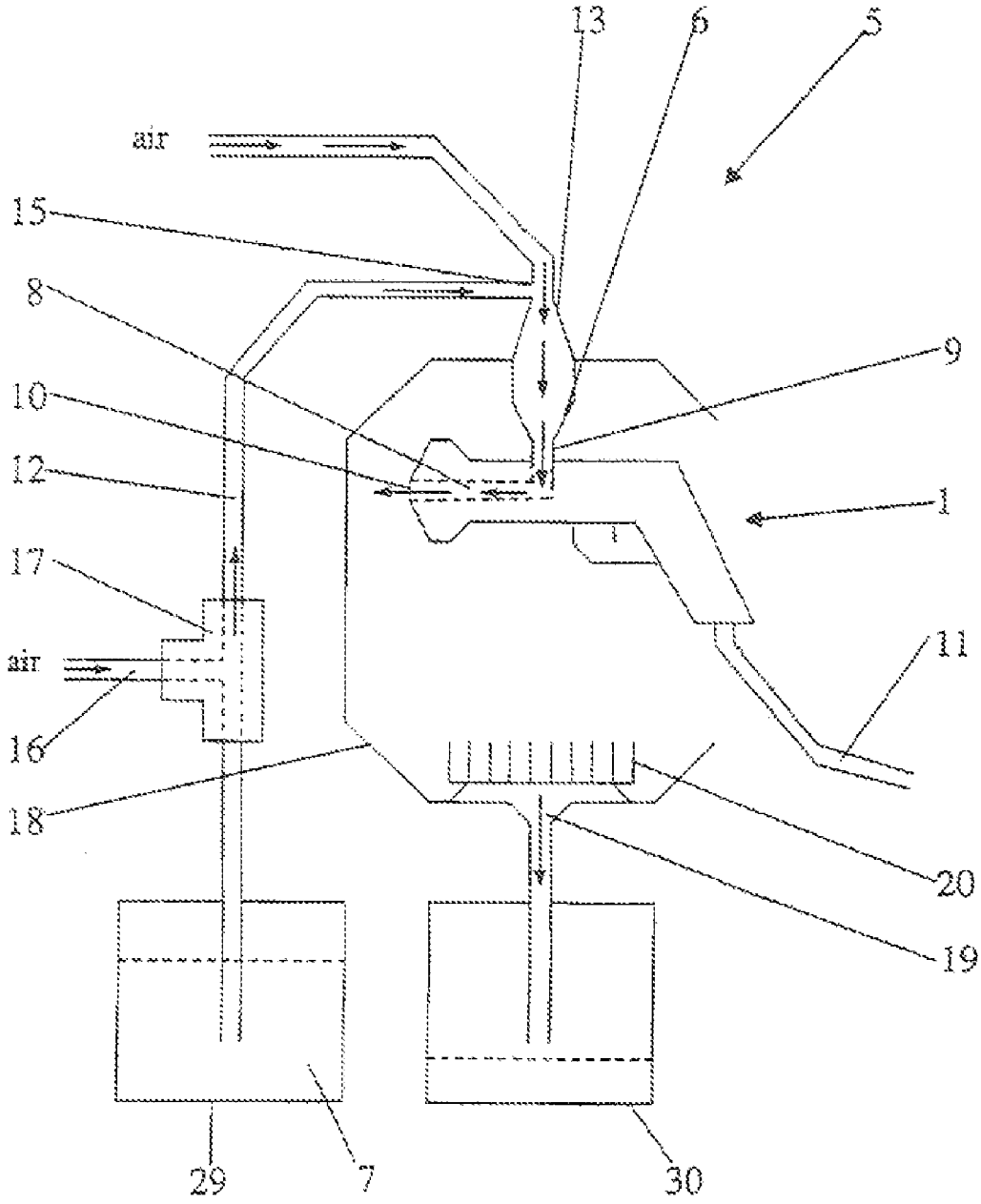
FIG. 6 depicts a cleaning unit having a venturi nozzle and a T-member with open air connection.
Figure 7:
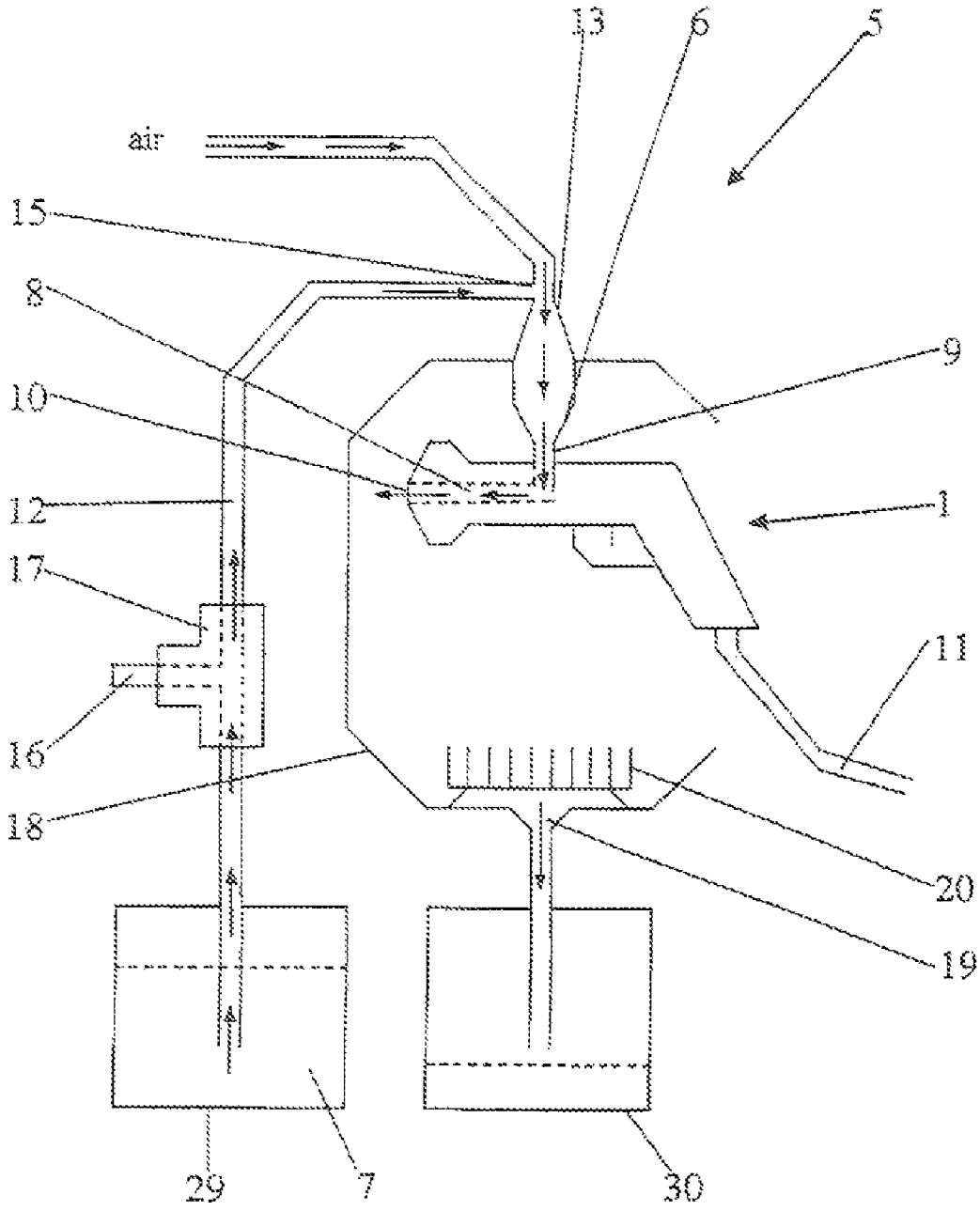
FIG. 7 depicts a cleaning unit having a venturi nozzle and a T-member with closed air connection.

FIG. 6 and FIG. 7 depict the cleaning of the spray gun (1) in accordance with another example of an embodiment of the invention. The cleaning unit (5) comprises a venturi nozzle (15) as described above in FIG. 5. On the media delivering system (12) is a T-member (17) positioned between container (29) comprising the cleaning media (7) and the venturi nozzle (15) communicating with the cleaning nozzle (6). The T-member (17) has one part which is communicating with the container (29), one part which is communicating with the venturi nozzle (15) and the cleaning nozzle (6), and one part comprising a valve in which air is introduced into the T-member (17). The valve which air is introduced into the T-member may be any desired valve. When the valve in the T-member (17) is in an open position air is introduced into the T-member (17). When the valve in the T-member (17) is in a closed position no air can enter into the T-member (17).

FIG. 6 depicts when the valve in the T-member (17) is in an open position. Air then flows through the T-member (17). The air, after entering the T-member (17), continues to the venturi nozzle (15) and then out through the cleaning nozzle (6). As air is introduced into the T-member (17) no cleaning media (7) from the container (29) is drawn up and led to the cleaning nozzle (6).

FIG. 7 depicts when the valve in the T-member (17) is in a closed position. As the valve is closed, cleaning media due to the function of the venturi nozzle (15), as described above in relation to FIG. 5, is led to the venturi nozzle (15) and out through the cleaning nozzle (6) into the paint distributing passage (8) of the spray gun (1).

Figure 8:
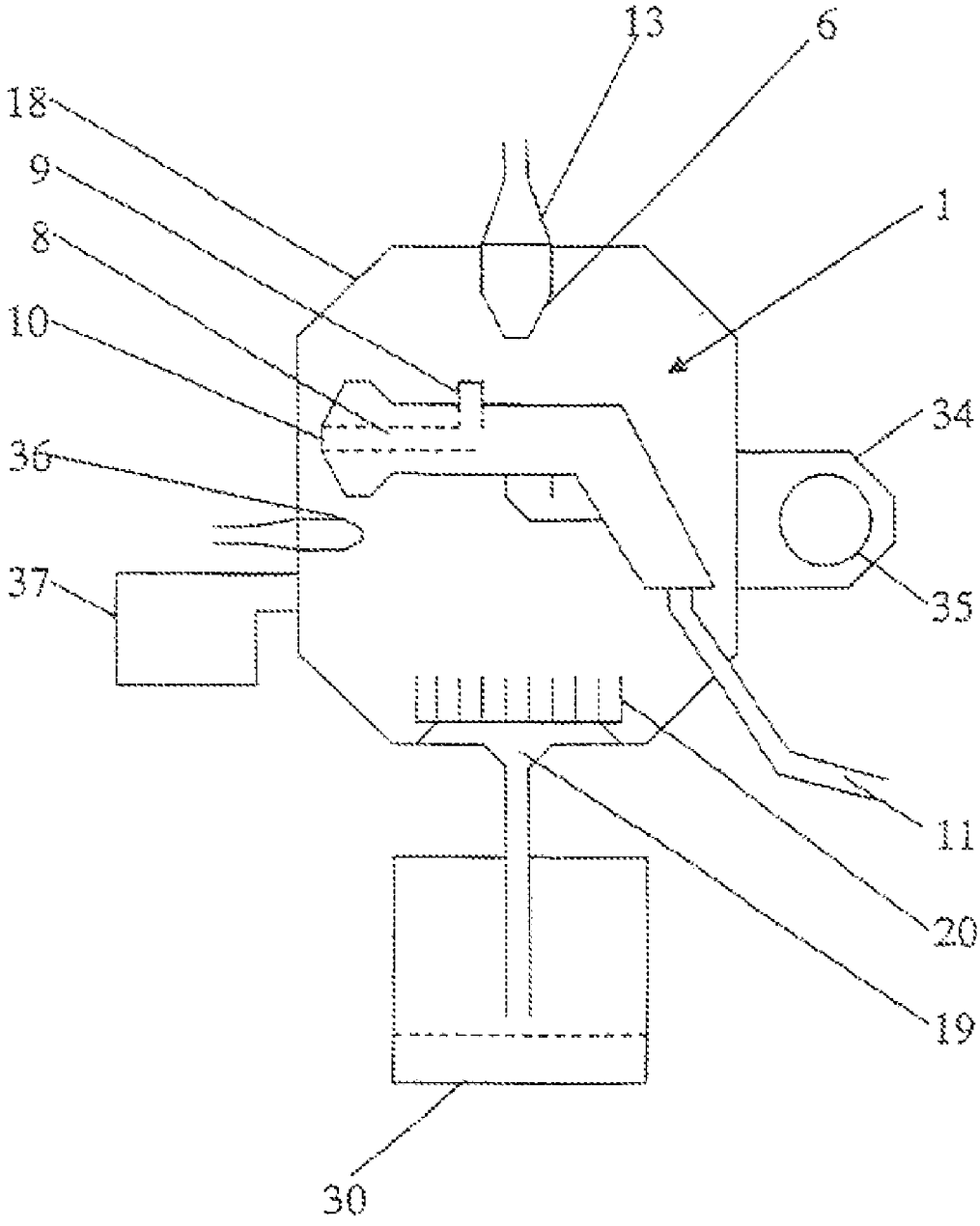
FIG. 8 depicts part of cleaning unit where a chamber comprises a washing means and vacuum tank.

FIG. 8 depicts a chamber (18) in accordance with an example of an embodiment of the invention where the chamber (18) comprises a second cleaning nozzle (36). The second cleaning nozzle (36) is located inside the chamber (18) on a side wall of the chamber (18).

FIG. 8 further depicts another example of an embodiment of the invention where the chamber (18) comprises a vacuum tank (34). The vacuum tank (34) is connected to the chamber (18). However, it can also be located in the vicinity to the chamber (18). The vacuum tank comprises a receiving funnel (35), whereby the spray nozzle (10) of the spray gun (1) is placed into the receiving funnel (35) (not shown in figures). A low pressure contained in the vacuum tank (34) generates a vacuum effect into the vacuum tank (34), whereby cleaning media and old paint contained in the paint distributing passage (8) is drawn out from the paint distributing passage (8) via the spray nozzle (10) and into the vacuum tank (34).

FIG. 8 further depicts an example of an embodiment of the invention where a washing means (37) is incorporated or connected to the chamber (18). The washing means (37) is constructed for receiving a paint cup and/or a lid and/or accessories to and for the spray gun (1) (not shown in figures), whereby the paint cup, lid and accessories to and for the spray gun is cleaned within in the washing means (37) in any desired manner.

It will be understood that various modifications can be made without departing from the spirit and scope of the claimed invention.

The invention claimed is:

1. A process for cleaning a spray gun, which during cleaning is held by a hand comprising the steps of:

positioning a cleaning unit in or within a direct vicinity to a paint spray booth or a preparatory area, the cleaning unit having an opening through which a spray gun held by hand is inserted to place the spray gun in a cleaning position in which cleaning media can pass through the spray gun, removing a first paint cup from the spray gun;

cleaning the spray gun by engaging a pain inlet of the spray gun with a cleaning nozzle of the cleaning unit and having cleaning media pass through the spray gun, wherein the hand or the spray gun extends through the opening while cleaning media passes through the spray gun.

2. The process for cleaning a spray gun according to claim 1 further comprising the steps of:

locating a second paint cup in or within a direct vicinity to the paint spraying booth;

replacing the first paint cup with the second paint cup by attaching the second paint cup to the spray gun;

wherein the step of cleaning the spray gun occurs before the first paint cup is replaced with the second paint cup.

3. The process for cleaning a spray gun according to claim 1, wherein the first paint cup is disposable.

4. The process for cleaning a spray gun according to claim 1, further comprising the step of:

activating the cleaning unit by moving the spray gun towards the cleaning nozzle on the cleaning unit.

5. The process for cleaning a spray gun according to clam 1, further comprising the step of:

providing a pedal that when engaged activates the step of cleaning the spray gun.

6. The process for cleaning a spray gun according to claim 1, further comprising the step of:

providing a button on the cleaning unit such that engaging the button activates the step of cleaning the spray gun.

7. The process for cleaning a spray gun according to claim 1, further comprising the step of:

providing a sensor on the cleaning unit such that the step of cleaning the spray gun is activated when the sensor is touched or exposed to a temperature, light, movement, or sound.

8. The process for cleaning a spray gun according to claim 1 further comprising the step of:

cleaning a paint distributing passage and a spray nozzle of the spray gun.

9. The process for cleaning a spray gun according to claim 1, further comprising the steps of:

providing the cleaning media in the form of a solvent;

feeding the cleaning media into the cleaning nozzle, wherein the cleaning nozzle upon activation opens and provides an outflow of the cleaning media;

directing the cleaning media into a paint distribution passage inside the spray gun through the paint inlet on the spray gun; and inducing pressure upon the cleaning media as it passes through the spray gun.

10. The process for cleaning a spray gun according to claim 9, further comprising the step of:

moving the cleaning media upon cleaning within the paint distributing passage in a backward and forward direction.

11. The process for cleaning a spray gun according to claim 9, further comprising the step of:

utilizing air that typically is used for generating a spray of paint from the spray gun to remove cleaning media inside the paint distribution passage after the spray gun is removed from the cleaning nozzle.

12. The process for cleaning a spray gun according to claim 9, further comprising the step of:

utilizing air from a secondary air pressure supply connected to the cleaning unit to remove the cleaning media located inside the paint distribution passage of the spray gun after the spray gun is removed from the cleaning nozzle and after subsequently connecting the secondary air pressure supply from the cleaning unit to the spray gun.

13. A method of using a paint spray booth comprising:

positioning a cleaning unit in or within a direct vicinity to the paint spray booth or a preparatory area, the cleaning unit having an opening through which a spray gun held by a hand is inserted to place the spray gun in a cleaning position in which cleaning media can pass through the spray gun, providing the cleaning unit with a cleaning nozzle, media delivery system, and valve;

communicating the valve with the media delivery system;

controlling the outflow of the cleaning media from the cleaning nozzle through the valve; and opening the valve by engaging a paint inlet on the spray gun with the cleaning nozzle such that cleaning media enters the paint inlet;

wherein the hand or the spray gun extends through the opening of the cleaning unit while cleaning media passes through the spray gun.

14. The method of using a spray paint both according to claim 13 further comprising controlling the outflow of cleaning media by integrating the valve into the cleaning nozzle.

15. A method for cleaning a paint distribution passage in a spray gun comprising:

positioning a cleaning unit in or within a direct vicinity to a paint spray booth or a preparatory area, the cleaning unit having an opening through which a spray gun held by a hand is inserted to place the spray gun in a cleaning position in which cleaning media can pass through the spray gun;

providing a paint inlet in the spray gun;

engaging the inlet with a cleaning nozzle of the cleaning unit;

applying pressure between the spray gun and the cleaning nozzle at the point of engagement;

directing the cleaning media exiting the cleaning nozzle into the paint distribution passage through the paint inlet;

directing the cleaning media through the distribution passage to a distribution passage exit into a spray nozzle of the spray gun to allow the cleaning media to clean and rinse the paint distribution passage;

positioning the spray gun at a distance from the cleaning nozzle;

contacting the spray gun with a wiping off element; and applying pressurized air onto the spray gun;

wherein the spray gun is continuously held by an operator during the cleaning method, and wherein the hand or the spray gun extends through the opening of the cleaning unit while cleaning media passes through the spray gun.

16. The method for cleaning a paint distribution passage in a spray gun according to claim 15 further comprising controlling the flow of cleaning media by integrating a valve into the cleaning nozzle.

17. A process for using and cleaning a paint spray gun, said process comprising the steps of:

positioning a cleaning unit in or within a direct vicinity to a paint spray booth or a preparatory area, the cleaning unit having an opening through which a spray gun held by hand is inserted to place the spray gun in a cleaning position in which cleaning media can pass through the spray gun, conducting a flow of a first paint from a first paint cup through an inlet to a paint distribution channel in the spray gun and from the paint distribution channel through a nozzle on the spray gun, directing a spray of the first paint from the nozzle of the spray gun toward an article disposed in a paint spraying booth, removing the first paint cup, which has been at least partially emptied of the first paint, from the inlet to the paint distribution channel while the spray gun is in the paint spraying booth or a preparatory area, conducting a flow of cleaning liquid along a flow path and through the inlet to the paint distribution channel by engaging the inlet with a cleaning nozzle of the cleaning unit, conducting a flow of the cleaning liquid through the paint distribution channel in the spray gun to the nozzle of the spray gun, wherein the hand or the spray gun extends through the opening of the cleaning unit while cleaning media passes through the spray gun, discharging cleaning liquid from the nozzle of the spray gun, collecting cleaning liquid discharged from the nozzle of the spray gun in a container, thereafter, conducting a flow of fluid to the inlet to the paint distribution channel while the spray gun is in the paint spraying booth or the preparatory area, conducting a flow of the fluid through the paint distribution channel in the spray gun while the spray gun is in the paint spraying booth or the preparatory area, discharging fluid from the nozzle of the spray gun while the spray gun is in the paint spraying booth or the preparatory area, thereafter, removing a second paint cup from an area in the paint spraying booth or the preparatory area, connecting the second paint cup with the spray gun while the spray gun is in the paint spraying booth or the preparatory area, conducting a flow of a second paint from the second paint cup through the inlet to the paint distribution channel and from the paint distribution channel to the nozzle on the spray gun while the spray gun is in the paint spraying booth or the preparatory area, and directing a spray of the second paint from the nozzle of the spray gun toward an article in the paint spraying booth while the spray gun is in the paint spraying booth or the preparatory area.

18. The process for using and cleaning a paint spray gun according to claim 17, wherein the step of conducting a flow of fluid to the inlet to the distribution channel comprises conducting a flow of only air to the inlet to the distribution channel.

* * * * *